US010773775B2

(12) United States Patent
Stehlik

(10) Patent No.: US 10,773,775 B2
(45) Date of Patent: Sep. 15, 2020

(54) FOIL STRONGBOX

(71) Applicant: Robert A. Stehlik, Honolulu, HI (US)

(72) Inventor: Robert A. Stehlik, Honolulu, HI (US)

( * ) Notice: Subject to any disclaimer, the term of this patent is extended or adjusted under 35 U.S.C. 154(b) by 0 days.

(21) Appl. No.: 16/664,438

(22) Filed: Oct. 25, 2019

(65) Prior Publication Data

US 2020/0130780 A1 Apr. 30, 2020

Related U.S. Application Data

(60) Provisional application No. 62/750,680, filed on Oct. 25, 2018.

(51) Int. Cl.
*B63B 1/24* (2020.01)
*B63B 32/60* (2020.01)
*B63B 32/66* (2020.01)

(52) U.S. Cl.
CPC ..... *B63B 1/242* (2013.01); *B63B 32/60* (2020.02); *B63B 32/66* (2020.02)

(58) Field of Classification Search
CPC ..... B63B 1/242; B63B 1/24; B63B 35/79; B63B 32/60; B63B 32/66
See application file for complete search history.

(56) References Cited

U.S. PATENT DOCUMENTS 5,176,553 A * 1/1993 Tuttle ..... B63B 32/66 441/79
6,019,059 A * 2/2000 Kelsey ..... B63B 32/60 114/274
6,170,904 B1 * 1/2001 Schaedlich ..... B62D 35/007 296/180.1
9,643,695 B1 * 5/2017 Breaux ..... B63B 32/60
9,663,198 B2 * 5/2017 Mair ..... B63B 32/66
9,688,365 B2 * 6/2017 Norrie ..... B63B 32/66
9,957,021 B2 * 5/2018 Scott ..... B63B 32/66
2005/0211423 A1 * 9/2005 Blake, Jr. ..... B63B 32/60 165/149
2013/0247807 A1 * 9/2013 Eveleth ..... B63B 1/242 114/39.24
2015/0017850 A1 * 1/2015 Modica ..... B63B 34/20 441/79
2018/0265174 A1 * 9/2018 Miller ..... B63B 32/60
2019/0106179 A1 * 4/2019 Ulgen ..... B63B 1/242
2020/0102052 A1 * 4/2020 Geislinger ..... B63B 1/242
2020/0130780 A1 * 4/2020 Stehlik ..... B63B 1/242

* cited by examiner

*Primary Examiner* — Lars A Olson
*Assistant Examiner* — Jovon E Hayes

(57) ABSTRACT

The present invention is a dual-purpose mounting system for attaching removable hydrofoils along a rideable board. The dual-purpose mounting system reduces repetitive stress exerted on the hull of the rideable board by foil bending and torsion, therefore prolonging the hull life of the rideable board. The dual-purpose mounting system is a solid one-piece constructed foil strongbox having a mounting body that is installed into a surfboard hull. A mounting receptacle is positioned within the mounting body to receive a tuttle style hydrofoil mount through a first hydrofoil aperture at a mounting surface of the mounting body. A pair of second hydrofoil apertures traverses into the mounting surface to further facilitate attachment of a plate style hydrofoil. A plurality of fastener sleeves traverses into the mounting body opposite the mounting receptacle enable attachment of the mounting body to the surfboard hull.

10 Claims, 11 Drawing Sheets

FOIL STRONGBOX

The current application claims a priority to the U.S. Provisional Patent application Ser. No. 62/750,680 filed on Oct. 25, 2018.

FIELD OF THE INVENTION

The present invention relates generally to hydrofoil surfing. More specifically, the present invention is a dual-purpose mount for hydrofoil surfing.

BACKGROUND OF THE INVENTION

A hydrofoil, or foil for short, is a fin-like structure used to direct fluid flow. Foils, fins, centerboards, skegs, and hydrodynamic keels can optimize lift, reduce drag, and stabilize a vessel hull or vehicle body (hereinafter generically referred to as "hulls") when mounted at a suitable angle of attack relative to the oncoming fluid. Foils also enhance drive and maneuverability in the fluid, acting in some ways like the friction of wheels on a solid surface. Here, a "fluid" may be either water or air.

Related fields include foils that vary the inherent fluid-dynamic characteristics of attached vessel hulls or vehicle bodies by deriving lift, altering trim, reducing turbulence, or diminishing wave resistance; in particular, removable fins and foils for surfboards, sailboards, and pleasure or sport vessels.

Foil mountings can be permanent or removable. For example, a foil can be permanently attached with fasteners or adhesive to an inner layer partially constructed hull, then both foil and hull can be overcoated or overwrapped with outer layers such as fiberglass and resin. Removable foils can be inserted and withdrawn from sockets built into the hull, and fixed in place with fasteners or the like. Removable foils allow a user to change the number, type, or position of foils, adapting the hull to different fluid-dynamic performance demands imposed either by different surrounding conditions, different users, or different types of use. They also allow a user to quickly replace a damaged foil, or remove foils for easier storage or transport.

These removal and replacement operations can take place on beaches and shores, or sometimes even in the water. In these settings, mountings that require few or no tools to remove and replace a foil are convenient. Many users will sacrifice convenience if the foils are likely to wholly or partially self-detach in strong or turbulent currents. On the other hand, some foils are intentionally made frangible so that a substantial impact causes them to break away rather than damage the hull or injure the user or a nearby person or animal.

Rigid mountings and rigid foils can be simple and rugged, but they affect maneuverability when rapid turns are desirable or when the flow direction of the ambient fluid may change suddenly. The fluid-pressure drop causes bubble formation in the turbulent water on the leeward side of the foil, and the resulting cavitation or "crabbing" increases drag and can cause loss of control of the board or other craft; if the foil leaves the water completely, stall occurs, and there is a loss of control similar to a land vehicle's hydroplaning in a water puddle. Multiple foils mounted rigidly at different angles aid in turning, but can create drag that reduces the speed of the craft while carving into the face of a wave or during straight-line travel. In a curve, a fin angled at a non-optimal orientation (not tangent to the curve) also increases drag. In addition, water leakage or shocks associated with repeated torsional stresses over time may cause strain damage to the foil mounting, or hull.

The present mounting options for hydrofoil mounts are not strong enough to withstand the extreme forces exerted by the foil in the surf. Additionally, they require too many installation steps and add weight without adding strength. It is therefore an objective of the present invention to introduce an apparatus that combines both a plate mount and tuttle mount in a one-piece mounting system. The mounting system is stronger and easier to install than each system installed individually.

The present invention is compatible with most hydrofoils on the market today. Some Foil companies sell foils with a "Deep Tuttle" mount that can be installed in a center Tuttle Box mount on the present invention. Other companies sell foils with a "Plate Mount" that can be installed into two US Box tracks mounted with 9 cm spacing using four plate mount screws and plates. The present invention is compatible with both types of systems and combines them both in a unit that is strong and easy to install.

Assembly of the present invention involves the following steps: A rectangular opening in the shape of the present invention is cut out of a surfboard or similar craft using a router. The present invention is glued into the board with a carbon base plate flush to the bottom laminate of the board; using thickened resin or a foaming adhesive such as Gorilla Glue. Once glued, the top of the present invention is sanded down to be flush with the top deck layer of the board. The installation area is then glassed over with several layers of fiberglass and/or carbon fiber with epoxy resin on both sides (both on the deck and the bottom of board). The openings for the Tuttle mount and the two plate mount tracks are cut out on the bottom and the two screw holes openings are cut out of the deck once the laminate has fully cured. Installed this way, the present invention provides a one-piece universal mount that is easier to install and stronger than other available installation options.

SUMMARY OF THE INVENTION

The present invention is a foil strongbox that provides a mounting system for attaching a surf hydrofoil to a surfboard. The user can install the mounting system into a channel cut into a surfboard. Once installed, the surfboard now supports removable hydrofoils and fins. In the preferred embodiment of the present invention, the removable hydrofoil may take the form of a mast-type hydrofoil assembly with a tuttle head connector.

The foil strongbox is a solid one-piece constructed dual purpose mounting system having a mounting body that is installed into a surfboard hull, with a mounting receptacle positioned within the mounting body to receive a tuttle style hydrofoil mount through a first hydrofoil aperture at a mounting surface of the mounting body. A pair of hydrofoil apertures traversing into the mounting surface further facilitate attachment of a plate style hydrofoil. A plurality of fastener sleeves traversing into the mounting body opposite the mounting receptacle enable attachment of the mounting body to the surfboard hull. The foil strongbox provides an all in one system for mounting plate and tuttle fin and foil attachments. In the preferred embodiment of the present invention, the mounting body may take the form of any suitable, rigid casing that facilitates the protection and containment of its components. The mounting receptacle is the core of the foil strongbox that resides within the housing. In the preferred embodiment of the present invention, the foil strongbox mounting system serves as the mounting platform for removably attaching hydro-foil attachments along the first hydrofoil receiving aperture and the second plurality of hydrofoil receiving aperture attachment openings.

The present invention can be installed into Surf and Stand Up Paddle boards, as well as Kite boards, and Windsurf boards. It can also be adopted for use on Kayaks, Surf Skis, electric powered foil boards, canoes as well as any other watercraft that a hydrofoil can be mounted to.

DETAIL DESCRIPTIONS OF THE INVENTION

Figure 1:
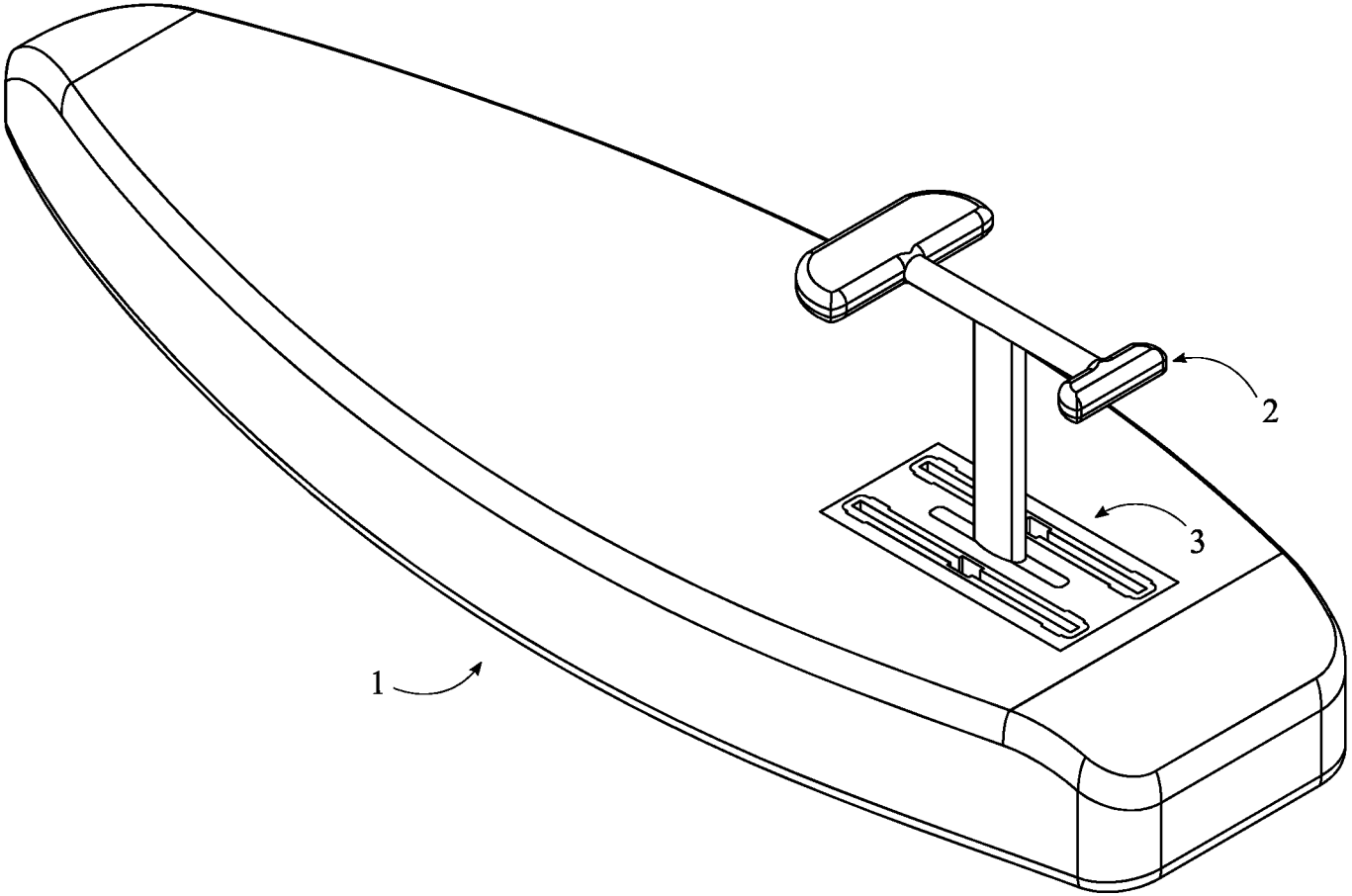
FIG. 1 is a perspective view of the present invention installed on to a surfboard.
Figure 2:
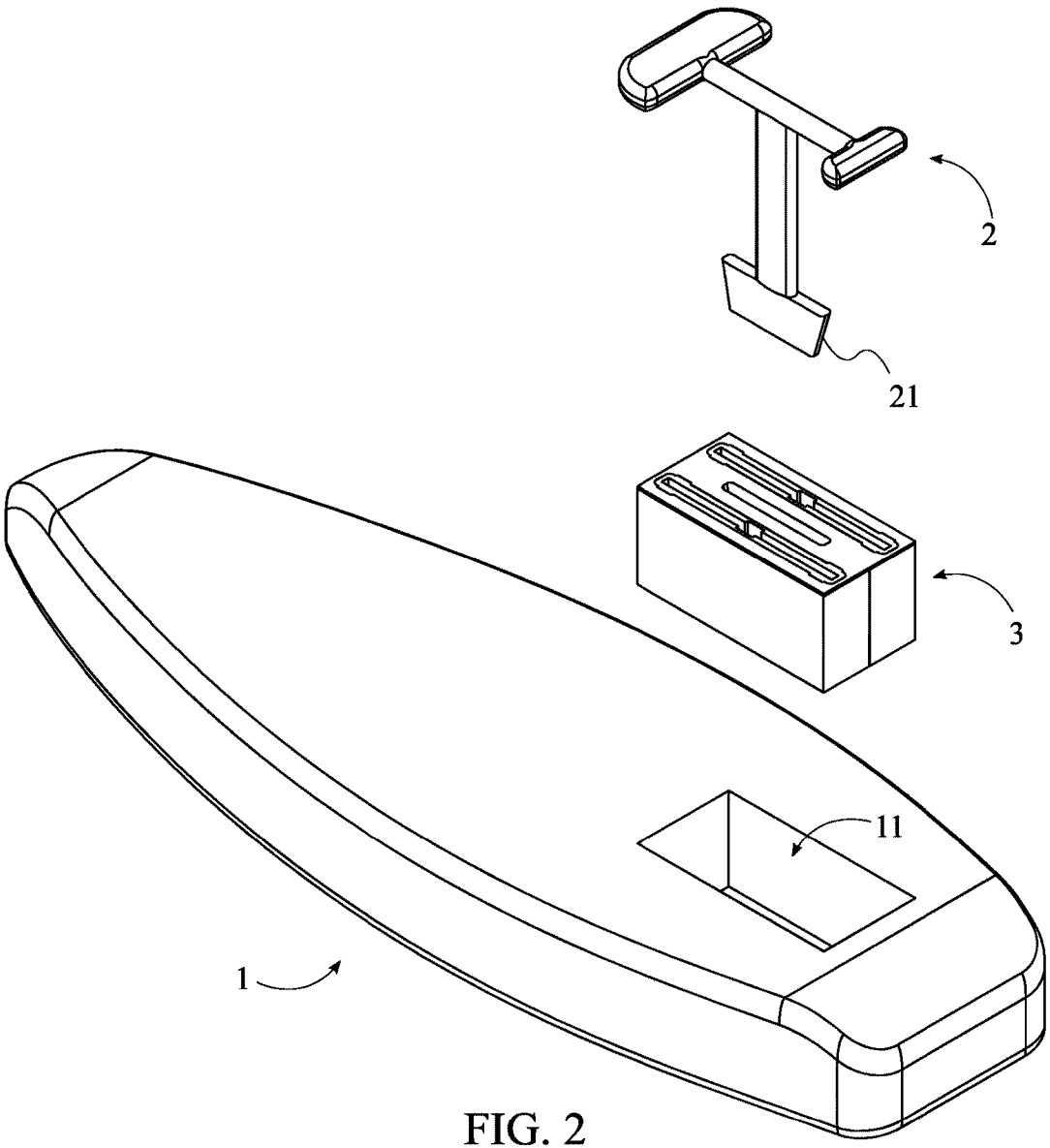
FIG. 2 is an exploded view of the present invention installed on to a surfboard.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

In reference to FIGS. 1-11, the present invention is a foil strongbox 3 that provides a mounting system for a surf hydrofoil along a surfboard 1. The foil strongbox 3 combines the two most common foil mounting systems into one unit that allows both systems to be installed together at once, making the installation process easier, faster, stronger and lighter. The user can install the mounting system along a cut surfboard channel 11. Once installed, the surfboard 1 now supports plate and tuttle fin surf-foils 2. In reference to FIGS. 1-10, the foil strongbox 3 provides an all in one system for mounting plate and tuttle fin and foil attachments. The present invention can be installed into Surf and Stand Up Paddle boards, as well as Kite boards, and Windsurf boards. It can also be adopted for use on Kayaks, Surf Skis, electric powered foil boards, canoes as well as any other watercraft that a hydrofoil can be mounted to.

In reference to FIGS. 1-10, the foil strongbox 3 mounting system comprises a mounting body 31, a mounting receptacle 32, a plurality of fastener sleeves 33, a plurality of fastening holes 34, a first hydrofoil receiving aperture 35, and a plurality of second hydrofoil receiving apertures 36. In reference to FIG. 3, the mounting body 31 is the main body of the foil strongbox 3 mounting system. In the preferred embodiment of the present invention, the mounting body 31 may take the form of any suitable, rigid casing that facilitates the protection and containment of its components. The mounting receptacle 32 is the core of the foil strongbox 3 that resides within the mounting body 31. In the preferred embodiment of the present invention, the foil strongbox 3 mounting system serves as the mounting platform for removably attaching hydro-foil attachments along the first hydrofoil receiving aperture 35 and the plurality of second hydrofoil receiving apertures 36 attachment openings. In the preferred embodiment of the present invention, the mounting body 31 may take the form of any suitable, rigid body material that facilitates the protection and containment of its components, such as, but not limited to, polyvinyl chloride (PVC) foam, carbon fiber, polymer/resin base composites, or any other suitable rigid body material. In the preferred embodiment of the present invention, the mounting body 31 may take the form of CNC-machined PVC foam blocks that install into the surfboard channel 11, shown in FIGS. 1-2, 5 and 11. The mounting body 31 further comprises a mounting surface 311. In reference to FIG. 10, the mounting surface 311 is oriented along the hydro-foil connection end of the mounting body 31.

Figure 3:
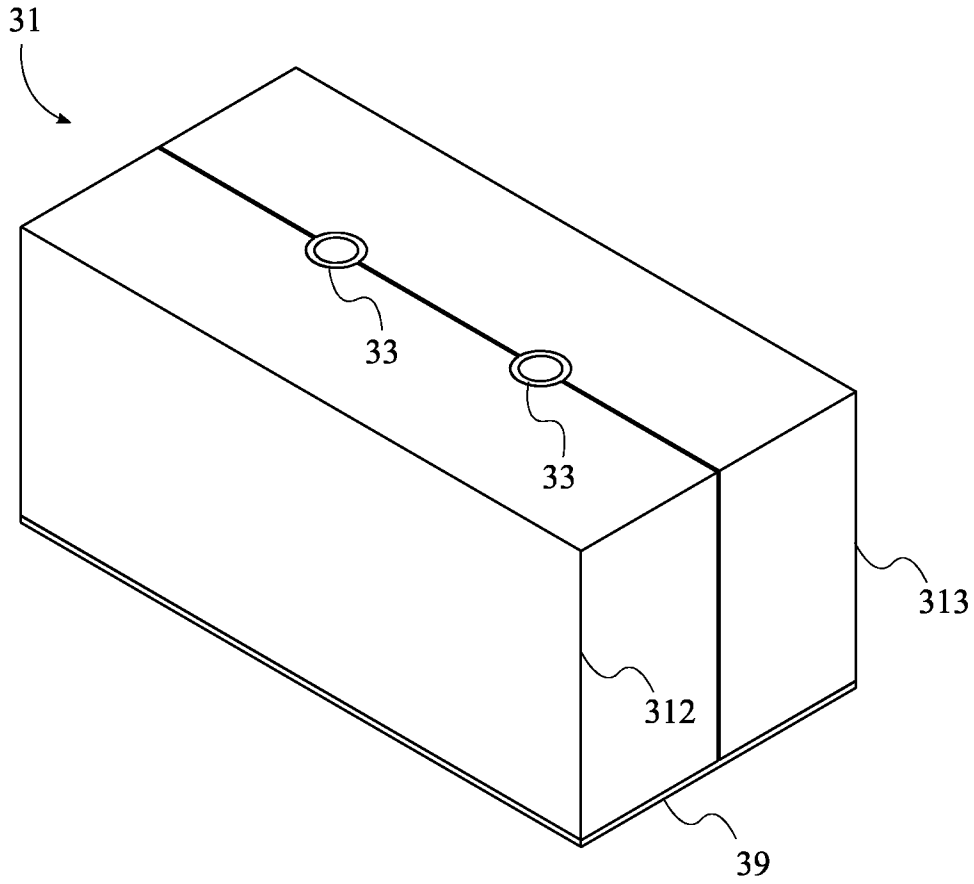
FIG. 3 is a top perspective view of the present invention.
Figure 4:
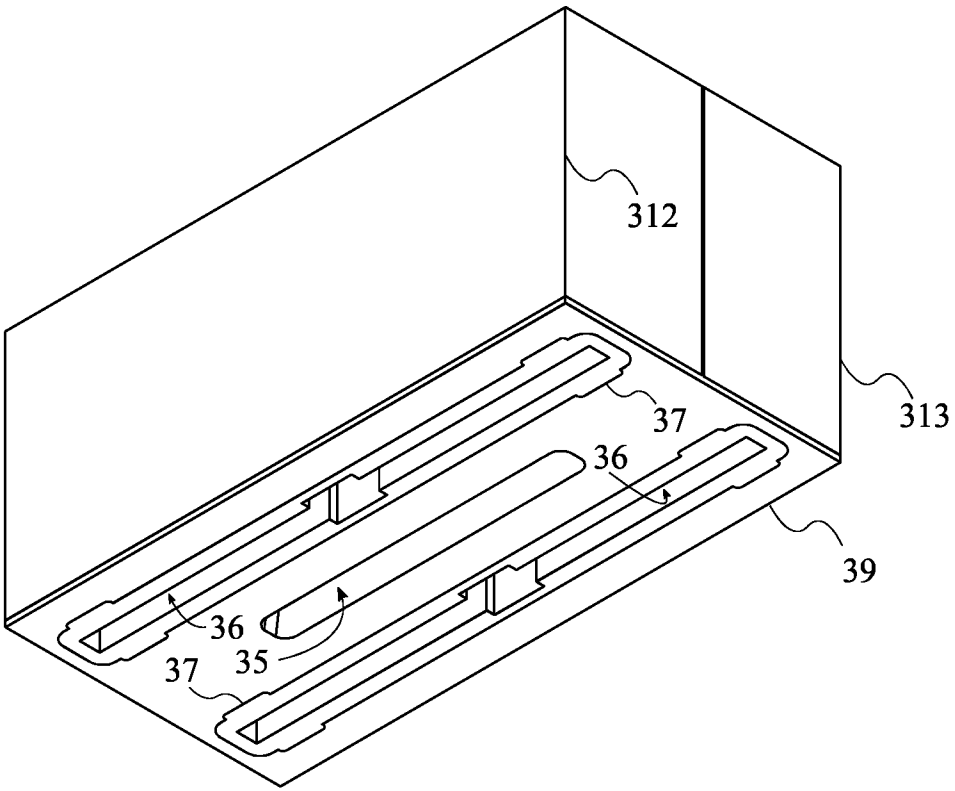
FIG. 4 is a bottom perspective view of the present invention.
Figure 5:
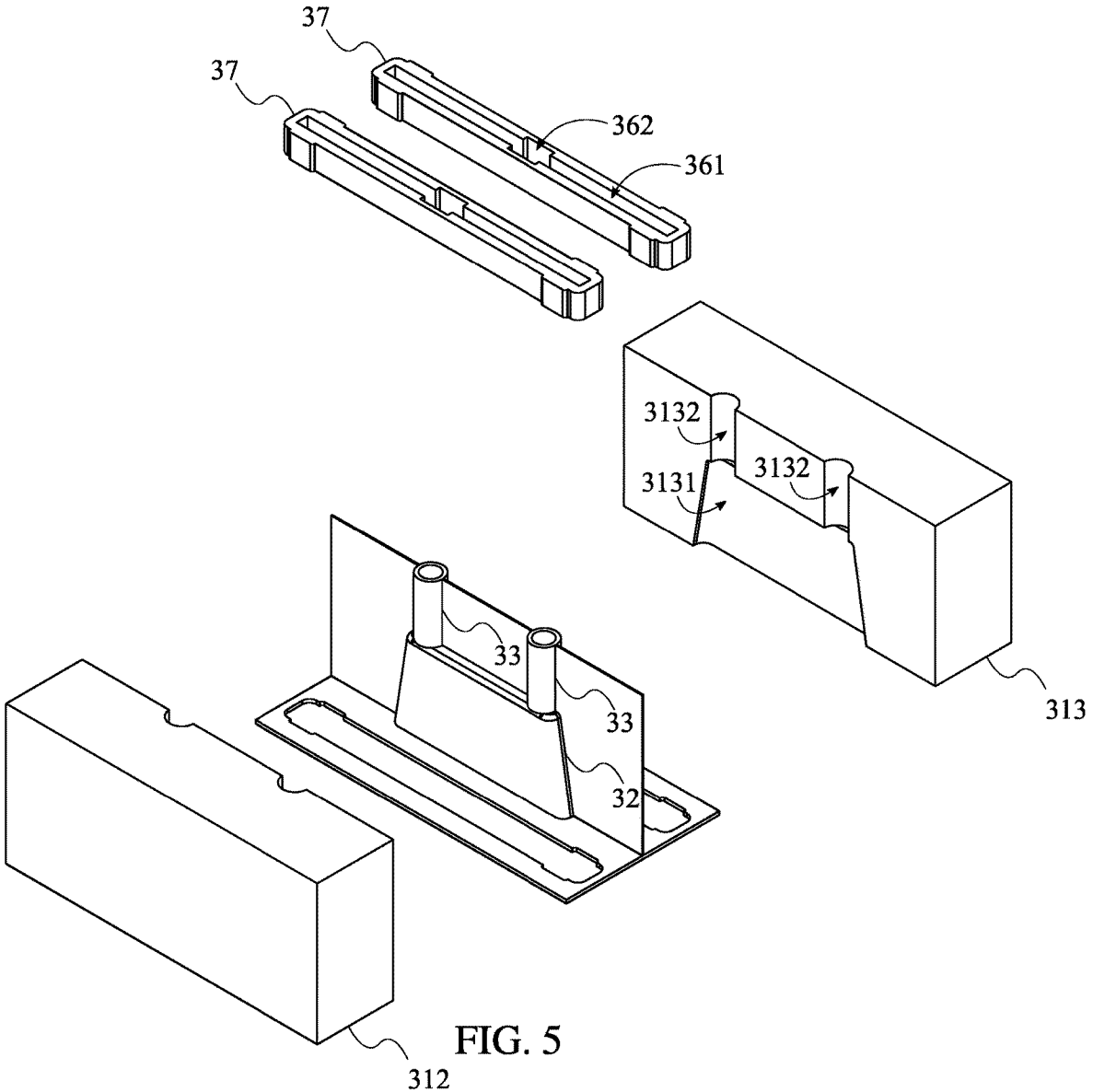
FIG. 5 is a top exploded view of the present invention.

In the preferred embodiment of the present invention, the mounting body 31 further comprises a first body half 312 and a second body half 313. In the preferred embodiment of the present invention, the first body half 312 and the second body half 313 are connected adjacent to each other, as shown in FIGS. 3-5. More specifically, the first body half 312 and the second body half 313 are conjoined together through any fastening means to create the mounting body 31. This fastening means can include adhesive, screw fasteners, welding, resin casting, or any other suitable means of conjoining the first body half 312 to the second body half 313.

Figure 11:
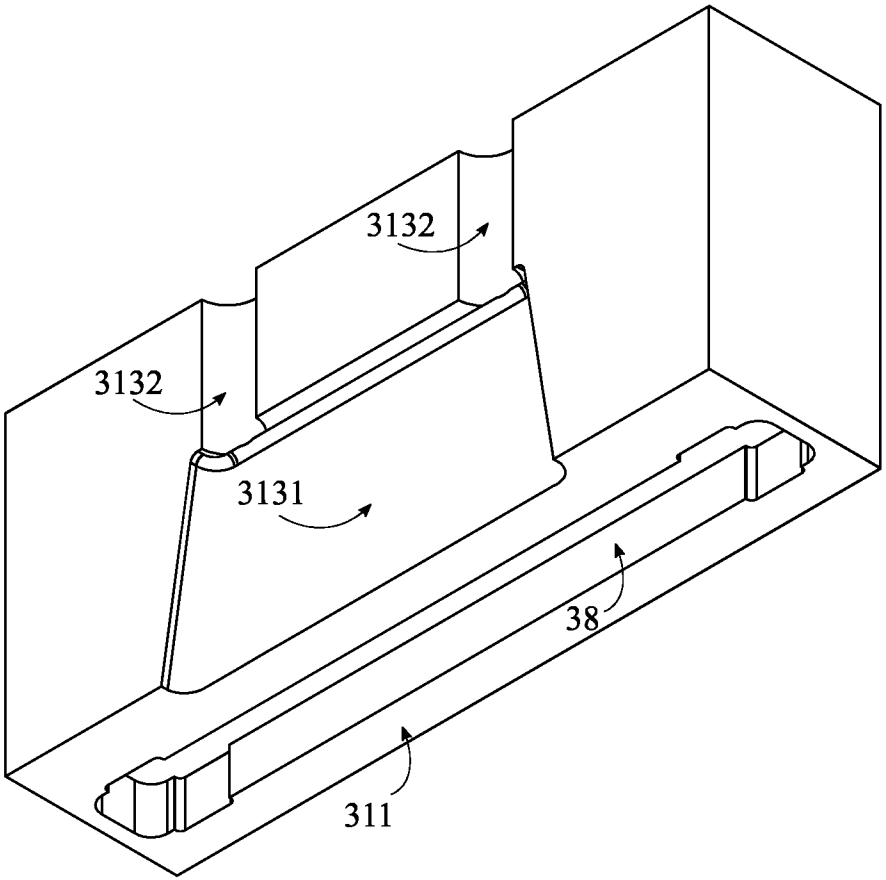
FIG. 11 is a bottom perspective view of the half-piece mounting body used in the present invention.

In reference to FIGS. 5, and 11, the first body half 312 and the second body half 313 each further comprise a receptacle cavity 3131 and a plurality of sleeve cavities 3132. The receptacle cavity 3131 is positioned adjacent to the mounting surface 311. The plurality of sleeve cavities 3132 is positioned adjacent to the receptacle cavity 3131, opposite to the mounting surface 311. The receptacle cavity 3131 and the plurality of sleeve cavities 3132 serves as interior impressions that secures and contains the mounting receptacle 32 and the plurality of fastening sleeves to the first body half 312 and the second body half 313 of the mounting body 31. In various embodiments of the present invention, the mounting body 31 may also be constructed as a singular unit, or in any number of parts.

Figure 9:
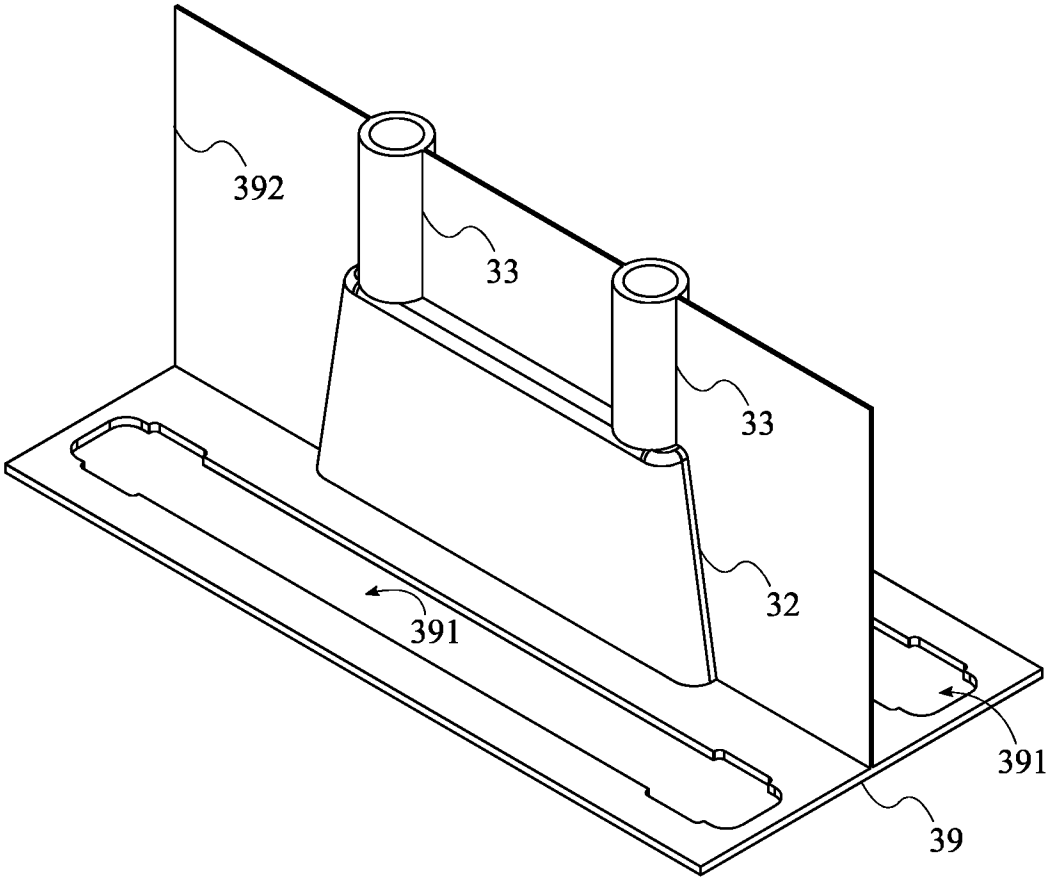
FIG. 9 is a top perspective view of a mounting receptacle core bracket used in the present invention.
Figure 10:
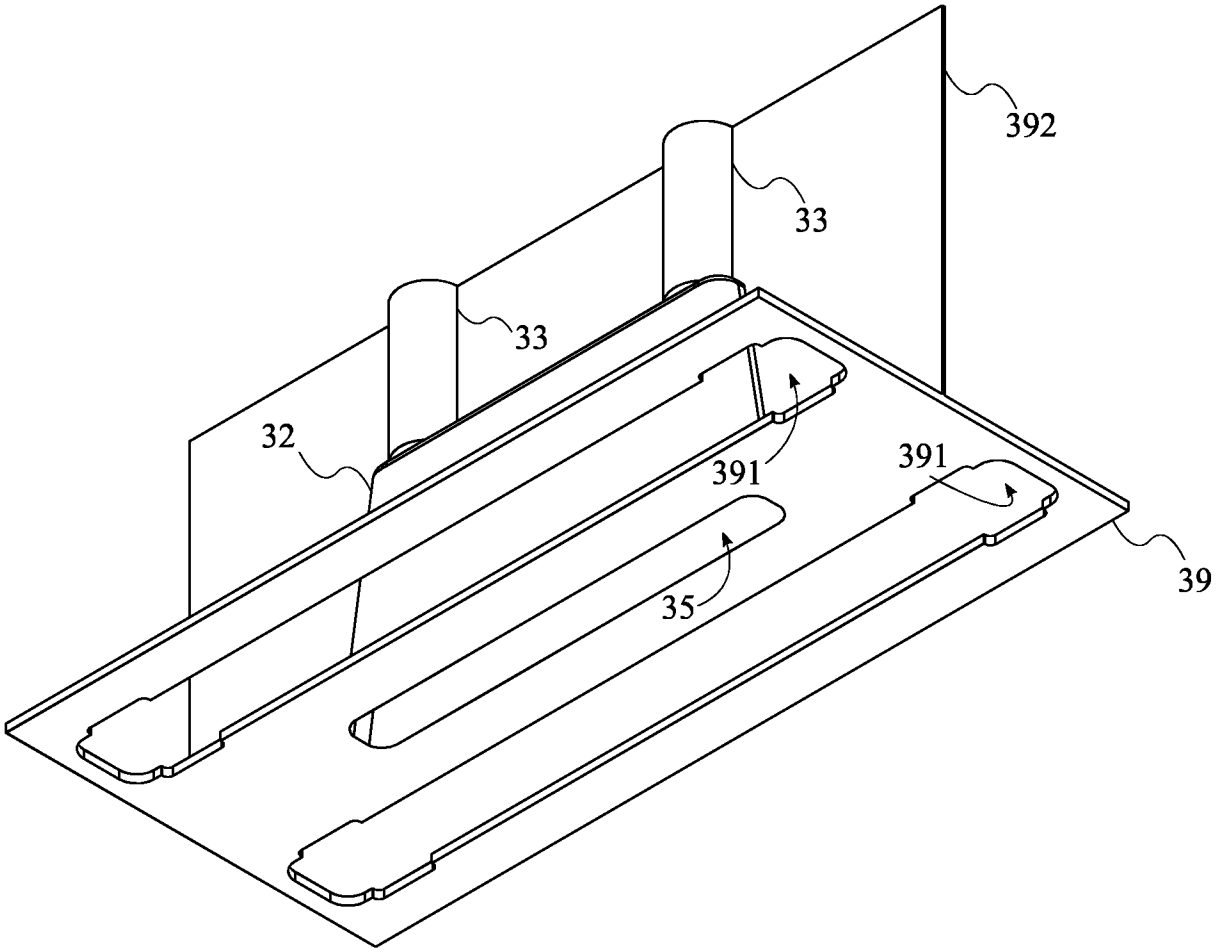
FIG. 10 is a bottom perspective view of the mounting receptacle used in the present invention.

In reference to FIGS. 5, and 9-10, the mounting receptacle 32 is positioned within the mounting body 31 adjacent to the mounting surface 311. Additionally, the mounting receptacle 32 is positioned within the receptacle cavity 3131 of the first body half 312 and the receptacle cavity 3131 of the second body half 313. In the preferred embodiment of the present invention, the mounting receptacle 32 may take the form of a tuttle-box style hydrofoil mount that seats a compatible tuttle box surf foil connector.

In reference to FIGS. 6-7, and 9-10, the plurality of fastening sleeves is positioned within the plurality of sleeve cavities 3132 of the first body half 312 and the plurality of sleeve cavities 3132 of the second body half 313. More specifically, the plurality of sleeve cavities 3132 along the first body half 312 and the second body half 313 are cavity halves that form a whole cavity, such that each fastening sleeve is positioned within one of the plurality of sleeve cavities 3132 of the first body half 312 and one of the plurality of sleeve cavities 3132 of the second body half 313. Additionally, the plurality of fastener sleeves 33 is positioned terminally adjacent to the mounting receptacle 32 opposite to the mounting surface 311. In the preferred embodiment of the present invention, the plurality of fastener sleeves 33 may take the form of mounting channels that facilitates the connection of the mounting receptacle 32 to a deck of the surfboard 1. In one embodiment, the plurality of fastener sleeves 33 is configured to accommodate bolt fasteners. In the preferred embodiment of present invention, the plurality of fasteners can also be cylindrical in shape but can take form of any desired shape or cross-section. Additionally, the plurality of fastener sleeves 33 can be strategically spaced from each other along the mounting receptacle 32.

Figure 6:
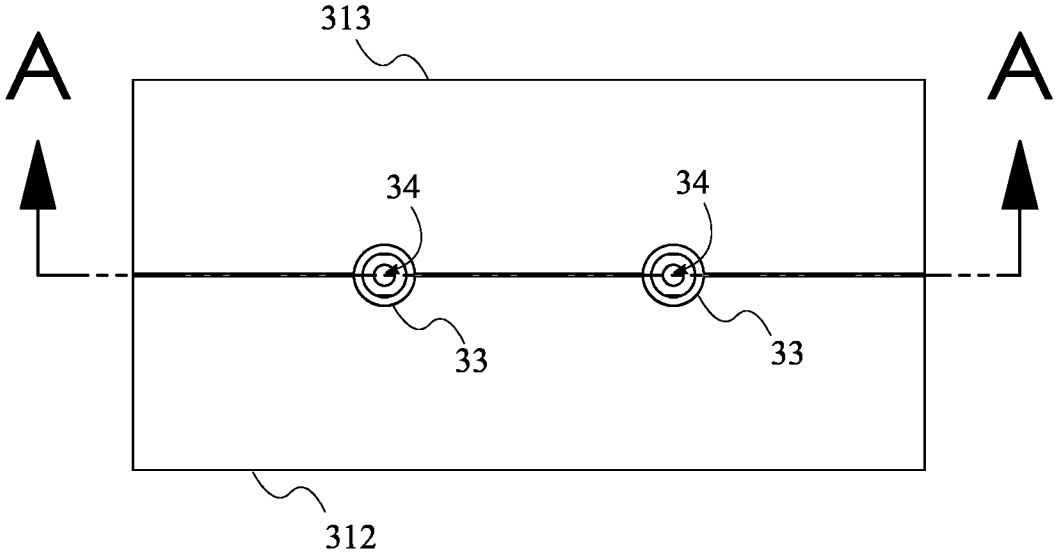
FIG. 6 is a top view of the present invention.
Figure 7:
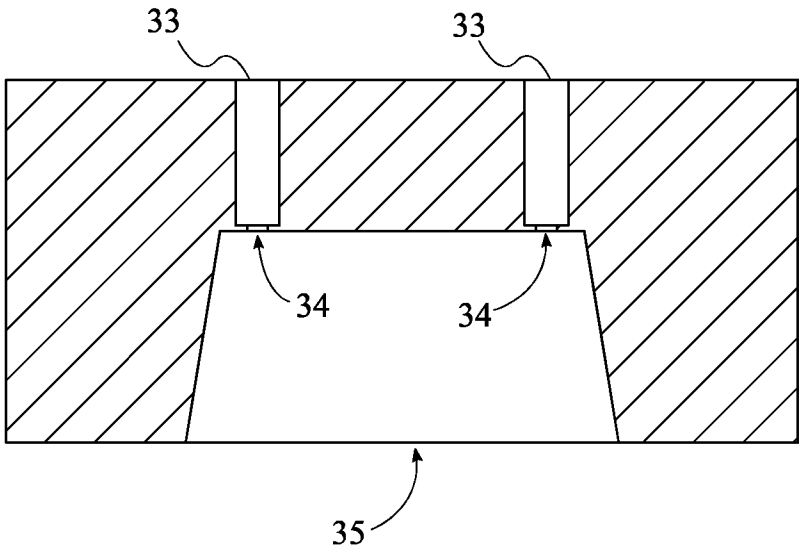
FIG. 7 is a cross-sectional front view of the present invention taken along cutting line A-A in FIG. 6.
Figure 8:
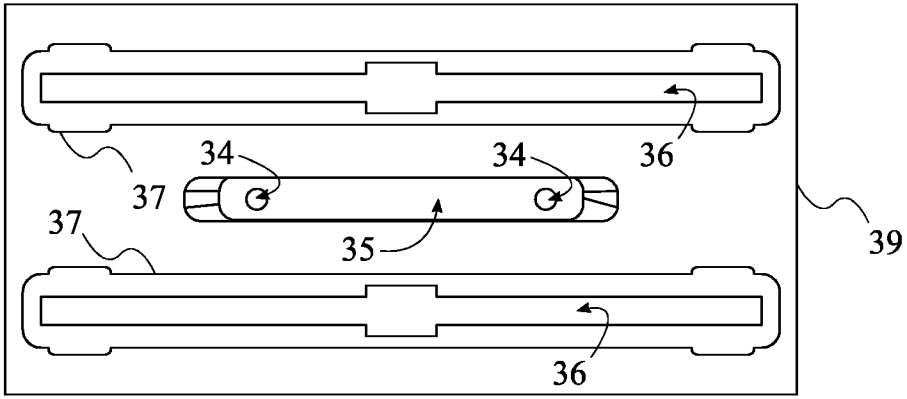
FIG. 8 is a bottom view of the present invention.

Each of the plurality of fastening holes 34 traverses between one of the fastening sleeves and the mounting receptacle 32, as shown in FIGS. 6-8. In the preferred embodiment of the present invention, the plurality of fastening holes 34 serves as mounting through holes that facilitate removable attachment of the mounting receptacle 32 to the deck of the surfboard 1. In the preferred embodiment of the present invention, the bolt fasteners traverses through the plurality of fastening sleeves, through the fastening holes, and into the mounting receptacle 32.

In reference to FIGS. 4, 7-8, and 10, the first hydrofoil receiving aperture 35 traverses into the mounting receptacle 32, opposite to the plurality of fastener sleeves 33. In reference to FIGS. 4, and 8, the plurality of second hydrofoil receiving apertures 36 traverses into the mounting body 31 adjacent to the mounting surface 311. The first hydrofoil receiving aperture 35 serves as the mounting opening that allows the user to install the tuttle-box surf foil connector along the mounting receptacle 32. The plurality of second hydrofoil receiving apertures 36 serves as mounting openings for plate style surf foil connectors, allowing the user to install plate surf foils along the mounting body 31.

In the preferred embodiment of the present invention, the plurality of second hydrofoil receiving apertures 36 further comprises a pair of second hydrofoil receiving apertures, facilitating attachment of a pair of plate surf foils, as shown in FIGS. 4, and 8. In the preferred embodiment of the present invention, the first hydrofoil receiving aperture 35 is positioned between the pair of second hydrofoil receiving apertures, facilitating the placement of the tuttle hydrofoil head connector 21 along the central portion of the surfboard 1, as shown in FIGS. 2, 4, 7-8. Additionally, the first hydrofoil receiving aperture 35 and the plurality of second hydrofoil receiving apertures 36 are oriented parallel to each other in order to accommodate typical plate style hydrofoil mounts.

In the preferred embodiment of the present invention, each of the plurality of second hydrofoil receiving apertures 36 further comprises a longitudinal aperture portion 361 and a central aperture portion 362, as shown in FIG. 5. In reference to FIG. 5, the longitudinal aperture portion 361 traverses along the plurality of second hydrofoil receiving apertures 36. The longitudinal aperture portion 361 serves as the mounting slit that positions and secures the plate surf foil along the mounting body 31. In reference to FIG. 5, the central aperture portion 362 is centrally positioned along the longitudinal aperture portion 361. The central aperture portion 362 serves as the attachment channel that facilitates the plate surf foil connector to removably attach the plate surf foil along the mounting body 31.

In the preferred embodiment of the present invention the foil strongbox 3 mounting system comprises a plurality of inserts 37 and a plurality of insert grooves 38, as shown in FIGS. 5, and 11. The plurality of insert grooves 38 traverses into the mounting body 31 through the mounting surface 311. The plurality of insert grooves 38 serves as channel cutouts along the mounting body 31 that facilitate the positioning and securement of the plurality of inserts 37 along the mounting body 31. In the preferred embodiment of the present invention, each half of the mounting body 31 comprises one of the insert grooves 38. Each of the plurality of inserts 37 is positioned within one of the plurality of insert grooves 38. In the preferred embodiment of the present invention, the plurality of inserts 37 serves as prefabricated play surf foil mounting pieces that facilitate the placement of the second plurality of hydrofoil apertures along the plurality of insert grooves 38, thus allowing the user to install plate surf foils along the mounting body 31.

In the preferred embodiment of the present invention, each of the plurality of second hydrofoil receiving apertures 36 traverses through one of the plurality of inserts 37. In the preferred embodiment of the present invention, the plurality of inserts 37 is fastened on to the plurality of insert grooves 38 with a strong adhesive such as, but not limited to, epoxy resin or any other suitable fastener that permanently bonds each of the plurality of inserts 37 within one of the plurality of insert grooves 38. In the preferred embodiment of the present invention, the insert may take the form of a prefabricated plate-style hydrofoil mount.

In the preferred embodiment of the present invention the plurality of insert grooves 38 further comprises a first insert groove and a second insert groove. The first insert groove traverses into the first body half 312 through the mounting surface 311. Similarly, the second insert groove traverses into the second body half 313 through the mounting surface 311.

In the preferred embodiment of the present invention, the foil strongbox 3 mounting system comprises a base 39, as shown in FIGS. 4-5, and 8-10. The base 39 is positioned adjacent and parallel to the mounting surface 311. In the preferred embodiment of the present invention, the base 39 serves as a mounting plate that reinforces the first hydrofoil aperture and the plurality of inserts 37 along the mounting body 31. In the preferred embodiment of the present invention, the base 39 may take the form of a carbon fiber plate, but can be made out of any suitable material such as but not limited to metal alloy, polymer composite, or any other suitable material that is lightweight, durable, and corrosion resistant. In the preferred embodiment of the present invention, the base 39 may further comprise a support plate 392. In reference to FIGS. 9-10, the support plate 392 is positioned parallel to the mounting receptacle 32 and the plurality of fastener sleeves 33. More specifically, the support plate 392 is positioned perpendicular to the mounting surface 311 and the base 39, between the first body half 312 and the second body half 313. The support plate 392 further reinforces the base 39 from buckling. The base 39 further comprises a plurality of slots 391.

In the preferred embodiment of the present invention, the plurality of slots 391 traverses through the base 39 as shown in FIGS. 9-10. Additionally, each of the plurality of slots 391 is perimetrically aligned with one of a plurality of insert grooves 38. The plurality of slots 391 serves as mounting openings for the plurality of inserts 37, allowing the plurality of inserts 37 to fit within the base 39, thus facilitating attachment of a hydrofoil within the plurality of inserts 37

In the preferred embodiment of the present invention, the mounting receptacle 32, the base 39, the plurality of fastening sleeves can be compression molded into a single carbon fiber core, as shown in FIGS. 9-10. The plurality of inserts 37 may take the form of injection molded US fin boxes, positioned within the base 39 and the CNC fabricated PVC foam mounting body 31, residing along the plurality of insert grooves 38 and the plurality of slots 391. The assembled components are then glassed with epoxy resin, forming the foil strongbox 3. The resulting block can be installed into a board by routing out a square hole into a surf or stand up paddle board, then glassed over to attach to both bottom and top skins of the board.

Although the invention has been explained in relation to its preferred embodiment, it is to be understood that many other possible modifications and variations can be made without departing from the spirit and scope of the invention as hereinafter claimed.

What is claimed is:

1. A foil strongbox mounting system comprising:

a mounting body comprising a mounting surface;

a mounting receptacle;

a plurality of fastener sleeves;

a plurality of fastening holes;

a first hydrofoil receiving aperture;

a plurality of second hydrofoil receiving apertures;

the mounting receptacle being positioned within the mounting body adjacent to the mounting surface;

the plurality of fastener sleeves being positioned terminally adjacent to the mounting receptacle opposite to the mounting surface;

the first hydrofoil receiving aperture traversing into the mounting receptacle, opposite to the plurality of fastener sleeves;

the plurality of second hydrofoil receiving apertures traversing into the mounting body adjacent to the mounting surface; and each of the plurality of fastening holes traversing between one of the fastening sleeves and the mounting receptacle.

2. The foil strongbox mounting system as claimed in claim 1 comprising:

a plurality of inserts;

a plurality of insert grooves;

the plurality of insert grooves traversing into the mounting body through the mounting surface;

each of the plurality of inserts being positioned within one of the plurality of insert grooves; and each of the plurality of second hydrofoil receiving apertures traversing through one of the plurality of inserts.

3. The foil strongbox mounting system as claimed in claim 1 comprising:

a base;

the base comprising a plurality of slots;

the plurality of slots traversing through the base;

the base being positioned adjacent and parallel to the mounting surface; and each of the plurality of slots being perimetrically aligned with one of a plurality of insert grooves.

4. The foil strongbox mounting system as claimed in claim 1 comprising:

the mounting body comprises a first body half and a second body half;

the first body half and the second body half being connected adjacent to each other;

the first body half and the second body half each comprising a receptacle cavity and a plurality of sleeve cavities;

the mounting receptacle being positioned within the receptacle cavity of the first body half and the receptacle cavity of the second body half; and the plurality of fastening sleeves being positioned within the plurality of sleeve cavities of the first body half and the plurality of sleeve cavities of the second body half.

5. The foil strongbox mounting system as claimed in claim 1 comprising:

the mounting body comprises a first body half and a second body half;

a plurality of insert grooves comprising a first insert groove and a second insert groove;

the first insert groove traversing into the first body half through the mounting surface; and the second insert groove traversing into the second body half through the mounting surface.

6. The foil strongbox mounting system as claimed in claim 2, wherein the at least one insert is a plate-style hydrofoil mount.

7. The foil strongbox mounting system as claimed in claim 1, wherein the mounting receptacle is a tuttle-box style hydrofoil mount.

8. The foil strongbox mounting system as claimed in claim 1 comprising:

the plurality of second hydrofoil receiving apertures comprising a pair of second hydrofoil receiving apertures; and the first hydrofoil receiving aperture being positioned between the pair of second hydrofoil receiving apertures.

9. The foil strongbox mounting system as claimed in claim 1 comprising:

the first hydrofoil receiving aperture and the plurality of second hydrofoil receiving apertures being oriented parallel to each other.

10. The foil strongbox mounting system as claimed in claim 1 comprising:

each of the plurality of second hydrofoil receiving apertures comprising a longitudinal aperture portion and a central aperture portion; and the central aperture portion being centrally positioned along the longitudinal aperture portion.

* * * * *